US005823292A

United States Patent [19]

Krause

[11] Patent Number: 5,823,292

[45] Date of Patent: Oct. 20, 1998

[54] CLAMP CONNECTOR FOR THE ASSEMBLY OF PREFABRICATED SHAPED-SECTION BARS TO FORM SCAFFOLDING

[75] Inventor: Günther Krause, Alsfeld, Germany

[73] Assignee: Krause-Werk GmbH & Co., KG, Alsfeld-Altenburg, Germany

[21] Appl. No.: 776,213

[22] PCT Filed: May 12, 1995

[86] PCT No.: PCT/EP95/01805

§ 371 Date: Mar. 20, 1997

§ 102(e) Date: Mar. 20, 1997

[87] PCT Pub. No.: WO95/34727

PCT Pub. Date: Dec. 21, 1995

[30] Foreign Application Priority Data

Jun. 10, 1994 [DE] Germany ..... G 94 09 418.7

[51] Int. Cl.[6] ..... E04G 7/00

[52] U.S. Cl. ..... 182/186.8; 182/119

[58] Field of Search ..... 182/119, 222, 182/186.7, 186.8; 403/49

[56] References Cited

U.S. PATENT DOCUMENTS

| | | | |
|---|---|---|---|
| 2,308,831 | 1/1943 | Roney et al. . | |
| 4,030,612 | 6/1977 | Gray | 403/49 |

FOREIGN PATENT DOCUMENTS

| | | | |
|---|---|---|---|
| 1362837 | 4/1964 | France | 182/119 |
| 1 399 674 | 9/1965 | France . | |
| 2 072 877 | 9/1971 | France . | |
| 384 189 | 1/1965 | Switzerland . | |
| 1 250 607 | 10/1971 | United Kingdom . | |
| 2 133 453 | 7/1984 | United Kingdom . | |

*Primary Examiner*—Alvin C. Chin-Shue

*Attorney, Agent, or Firm*—Flynn, Thiel, Boutell & Tanis, P.C.

[57] ABSTRACT

A clamp connector for scaffolding must not only make it possible to join two scaffolding components rapidly and securely but also be inexpensive to manufacture, have a long life and be suitable for use with a wide variety of scaffolding designs. To this end, the invention calls for there to be an aperture (PA) in each of the shaped-section bars of the scaffolding units to be fixed together, the aperture being designed to hold a crossbar (12) and to be locked by a moving clamp (6).

16 Claims, 3 Drawing Sheets

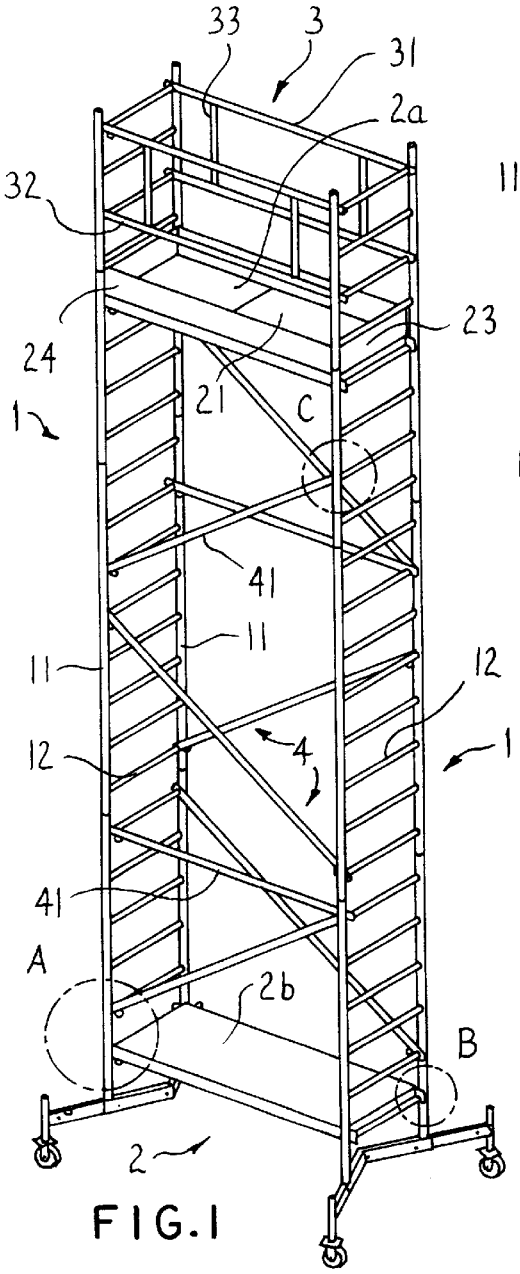
FIG.1
FIG.2
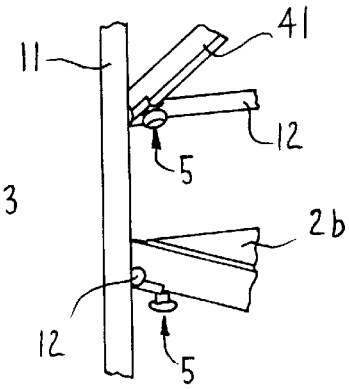
FIG.3
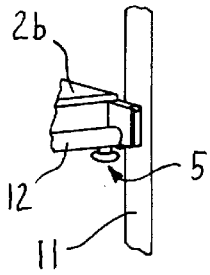
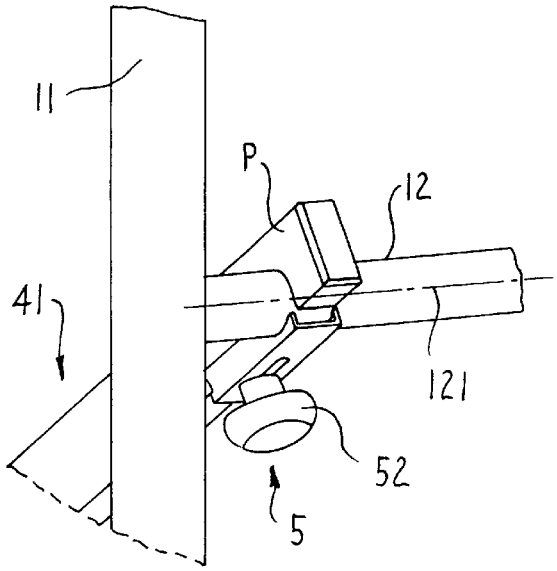
FIG.4

CLAMP CONNECTOR FOR THE ASSEMBLY OF PREFABRICATED SHAPED-SECTION BARS TO FORM SCAFFOLDING

FIELD OF THE INVENTION

The invention relates to a clamp connector for the assembly of prefabricated structural elements manufactured out of shaped-section bars to form a scaffolding. Such a scaffolding has, as a rule, lateral frame elements on two vertical posts and horizontal crossbars connecting the posts, with the shaped-section bars being fastened essentially to said crossbars or, auxiliarily, also to short brackets with the same or similar cross section, which brackets are fastened to the posts, whereby the shaped-section bars can already be assembled into one structural group and their longitudinal axes stand on the longitudinal axes of the cross bars or brackets, and, furthermore, whereby the shaped-section bars can be placed with their end areas, which are used for the connection to the crossbars or brackets, inclined or vertically from above onto the crossbars or brackets.

BACKGROUND OF THE INVENTION

Clamp connectors of this type are extensively needed in the building of scaffolding in order to be able to safely and quickly repeatedly connect and disconnect the frame elements, platforms, spars, reinforcements and other structural elements, in particular for scaffolding consisting of prefabricated structural elements.

Whereas the shapes of the structural element to be connected can be manufactured essentially as desired at the connecting point for the clamp connector, and merely its safe fastening must be guaranteed, the crossbars and brackets are designed with a continuously constant cross section adapted to the clamp connector.

The purpose of the invention is to design such clamp connectors in such a manner that they consist of only a few structural parts, which can be fabricated inexpensively in large numbers via a highly efficient process, in particular via an extrusion process, and that high-load supporting welding seams are not needed.

SUMMARY OF THE INVENTION

The purpose is attained according to the invention in such a manner that in the end areas of the shaped-section bars there is provided an aperture receiving the crossbars or the brackets, the axis of symmetry of the aperture is directed transversely with respect to the longitudinal axis of the shaped-section bars, and the aperture is open by a slot on the underside of the associated shaped-section bar so that it can be moved over the associated crossbar or the bracket. Furthermore, the aperture is dimensioned such that the shaped-section bar rests with its longitudinal axis nonmovably on the crossbar or the bracket, and finally clamps, which can be moved at least partially parallel to the longitudinal axis of the respective shaped-section bar and can be locked in place, are provided on the end areas of the shaped-section bars. The clamps in a closed position cover the slot of the respective aperture to clamp the crossbar or the bracket in the aperture of the shaped-section bar.

Such a clamp connector requires only very few additional connecting elements and does not require any supportive welding connections. The positive connection of the respective structural element to a crossbar or a bracket is thereby secured by the frictional lock created by the clamping of the clamp in the position specified by the positive lock, which frictional lock can be carried out with little operating force, so that a secure clamp connection can be achieved.

It is sufficient when at least two of the apertures are provided on the shaped-section bars and can be locked with clamps on each individual structural element. For example, the apertures can therefore remain unlocked on the intermediate spars of a railing provided on the scaffolding when they form a solid railing frame with the railing spars of said railing and the railing spars are already equipped with clamp connectors of the invention.

The area of the wall of the recess, which area rests on the crossbar or the bracket, is best shaped in such a manner that it rests approximately with a flat continuous contact on the crossbar or the bracket, because the surface pressure is then small and deformations are eliminated.

It is sufficient when one locking device is provided, with the help of which the clamp can be locked at least in one closed and one opened position with reference to the aperture. By suitably designing the locking device, any desired inbetween positions are also possible.

The clamp can be designed in detail in such a manner that it is constructed as a shaped-section piece parallel with the associated shaped-section bar. The clamp is advantageously provided along direction of its longitudinal axis with a slotted hole in a bar, which bar is used as a clamping surface. A bolt of the locking device extends through the slotted hole, which bolt can be screwed into the shaped-section bar. The clamp is in this matter stationary and nonloosably axially movable by the shaped-section piece and can be fixed in a desired position.

The clamp connector is particularly handy when the bolt is designed as a threaded bolt, and the clamp can be clamped by means of a handle nut provided on the bolt. It is understood that other operating elements are also conceivable, for example, a toggle-lever operation. At any rate, the parallel alignment of clamp and shaped-section bar should be guaranteed, for example, by providing a spacer between the bar and the shaped-section bar, for example, a nut fastened to the clamp or the shaped-section bar, which nut is at the same time used for extending the internal thread for fixing the threaded bolt therein.

It is advantageous when a pressure surface of the clamp for clamping to the crossbar or the bracket follows the cross-sectional shape of the crossbar so that together with the wall of the aperture, the clamped cross section of the pressure surface and crossbar abut all around the periphery thereof and is not subjected to the danger of a deformation.

A particularly good support for the clamp is achieved when the shaped-section bar is designed with a rectangular hollow shape, the clamp piece with a U-shape, and the belts of the U-shape rest on the sidewalls of the shaped-section bar.

With the help of the clamp connector of the invention, it is possible to connect a platform, an at least diagonal longitudinal or transverse reinforcement, a longitudinally or transversely extending railing or intermediate spar of the railing or another similar structural element to a crossbar or a bracket on a post. In as far as these structural elements have the same cross section in their shaped-section bars, one single design of the few structural parts and of the aperture on the shaped-section bars is sufficient for all needed clamp connections.

BRIEF DESCRIPTION OF THE INVENTION

The invention will be discussed in greater detail hereinafter in connection with one exemplary embodiment and the drawings, which are schematical illustrations.

FIG. 1 illustrates a (travelling) scaffolding built by means of clamp connectors of the invention, FIGS. 2 to 4 illustrates (enlarged) clamp connectors of FIG. 1 corresponding with the details A, B and C, FIG. 5 illustrates the clamp connector of FIG. 4, however, it is shown inclined and further enlarged, FIG. 6 illustrates a railing area and FIG. 7 a platform of FIG. 1, however, shown slightly turned, all in a three-dimensional illustration, FIG. 8 is a front view of the clamp connector of the invention, and FIG. 9 is a side view along direction arrow D of FIG. 8.

DETAILED DESCRIPTION

Figure 6:
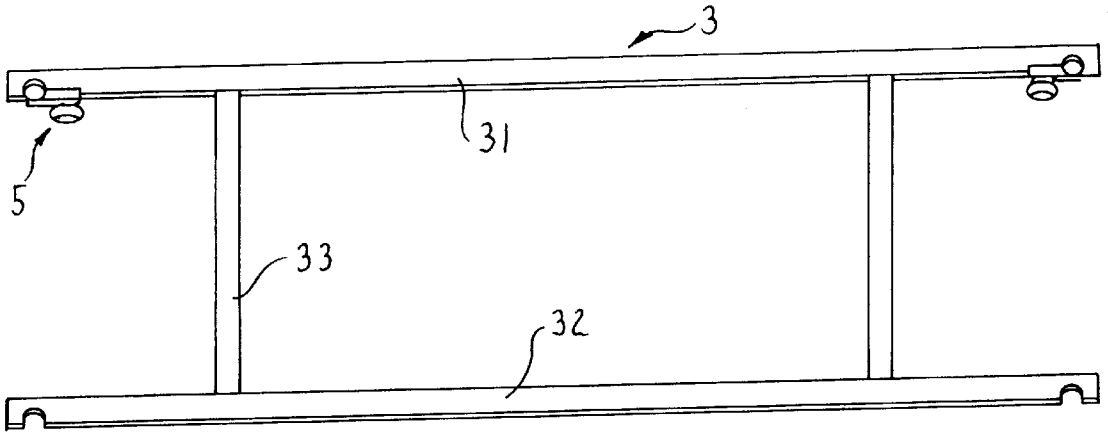

FIG. 1 shows a typical scaffolding, which is here provided with an undercarriage. It consists of a number of structural elements, which can be found again and again in such scaffolding. Lateral multiple frame elements 1 consist of vertical posts 11 and horizontal crossbars 12 connecting the posts 11. The crossbars 12 are here also used as ladder rungs and are welded with a suitably narrow spacing on the posts 11. They are therefore well suited to connect the frame element 1 to the other structural elements of the scaffolding. Short brackets can be provided on the posts 11, in particular when connections of other structural elements are needed in places where a crossbar 12 is not available, for example, when transverse reinforcements must be connected. The following discussions generally referred to crossbars 12 apply also to those brackets not shown in the drawings.

Figure 7:
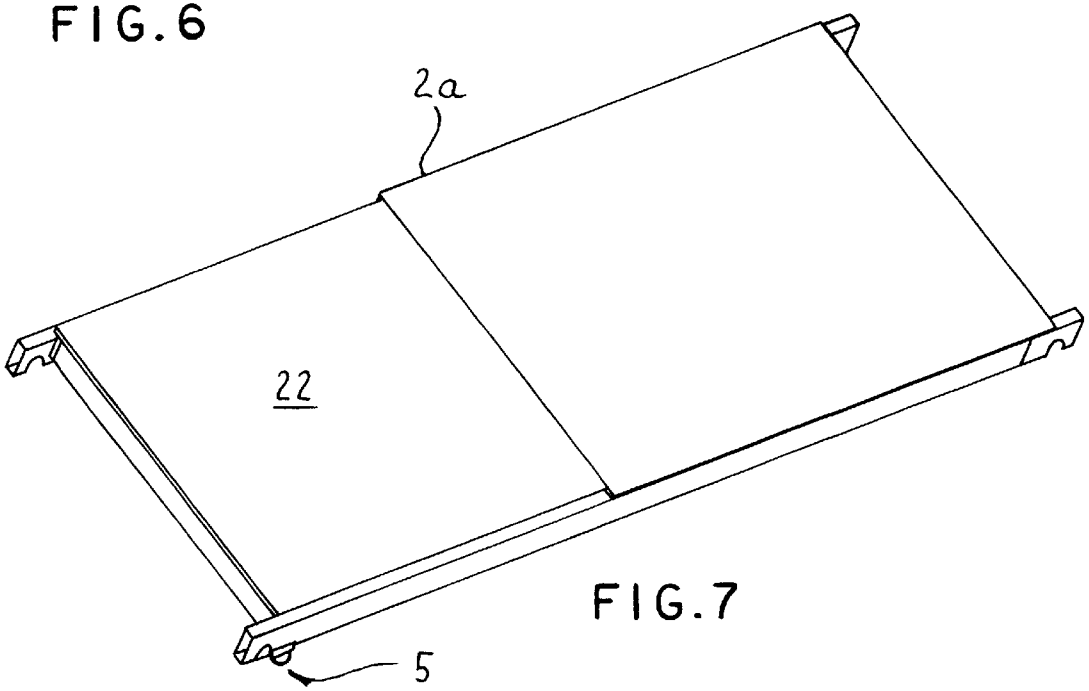

Thus two horizontal platforms 2 are fastened to the frame elements 1, of which platforms the upper platform 2*a* has an opening 21, which can be closed off with a flap 22 (FIG. 7), and is defined by transverse and longitudinal edges 23 and 24. Furthermore, the platform 2*a* is secured by a railing 3, which consists of railing spars 31, intermediate spars 32 and connecting pieces 33 (FIG. 6). The lower platform 2*b* does not need a railing 3. Finally, longitudinal reinforcements 41 of a reinforcement 4, which may possibly also include transverse reinforcements, are provided, which together with the platforms 2 give the scaffolding sufficient rigidity.

The crossbars 12 consist advantageously, like the posts 11, of circular-cylindrical pipes, however, other shapes are conceivable and can also be easily connected to the clamp connector of the invention, which is then to be designed slightly differently in shape. In contrast to this, all other structural elements are assembled out of shaped-section bars P, which have in cross section a rectangular hollow shape as can be seen with greater detail in FIGS. 4 and 5. These shaped-section bars P can also instead have a differently shaped cross section. However, independent from the respective structural element, the shaped-section bars P advantageously have the same dimensions so that uniformly dimensioned clamp connectors are possible and only few different structural elements are needed.

Figure 8:
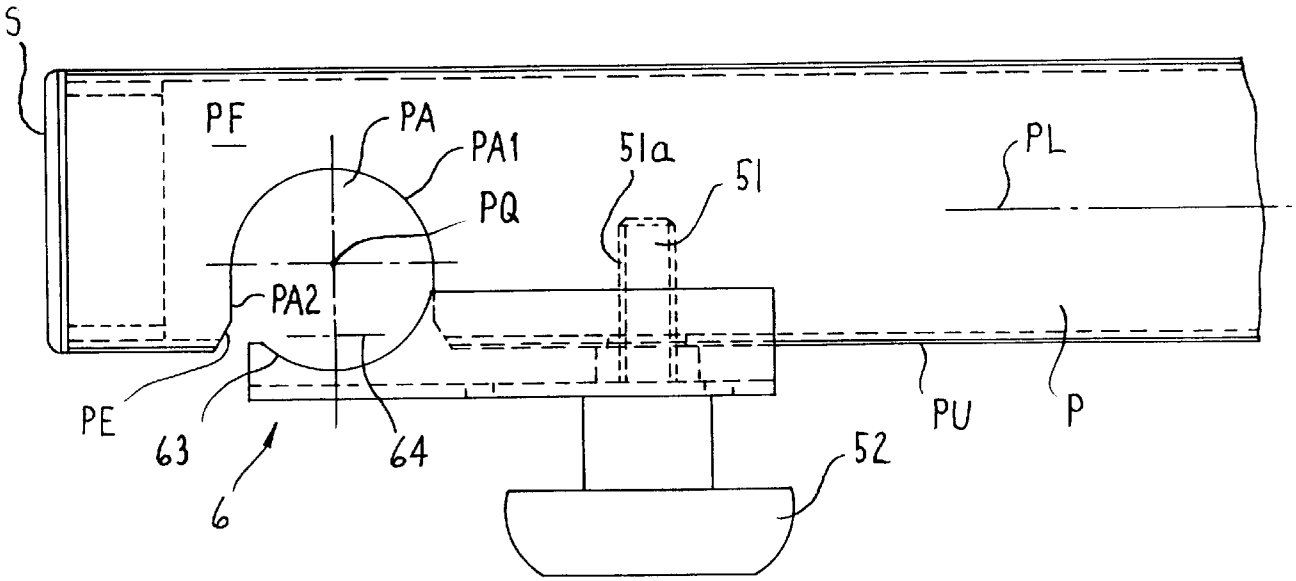
Figure 9:
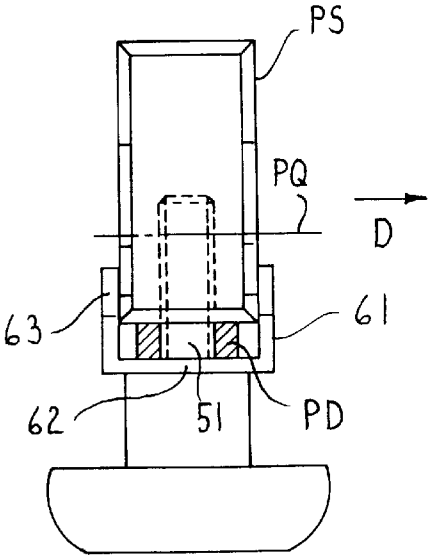

The area of a clamp connector of the invention can be seen in detail in FIGS. 8 and 9. The shaped-section bar P is (on both sides) closed off with a plug S. An aperture PA is provided in an end area PF of the shaped-section bar P, has an axis of symmetry PQ perpendicular with respect to the longitudinal axis PL of the shaped-section bar P, and is shaped like the crossbar 12 its upper area PA1 in the direction of the longitudinal axis 121 (FIG. 4) of the crossbar 12 so that the aperture PA rests flat on the associated crossbar 12. A slot PA2 opens the aperture PA toward the underside PU of the shaped-section bar P, and is dimensioned such that the shaped-section bar P rests with only a little clearance in the direction of its longitudinal axis PL above the crossbar 12. Feed slopes PE assist in feeding the crossbar 12 into the aperture PA.

A bolt 51 of a locking device 5 is stationarily, however, screwably, provided engaging a thread 51*a* on the shaped-section bar P. A spacer PD is welded to the shaped-section bar P to extend the internal thread of the thread 51*a* and to ensure that a clamp 6 is spaced at such a distance from the shaped-section bar P that it is approximately parallel with the same when the associated crossbar 12 is placed in the aperture PA and is held by the clamp 6. A handle 52 fixed on the bolt 51 makes the operation thereof easier.

Figure 5:
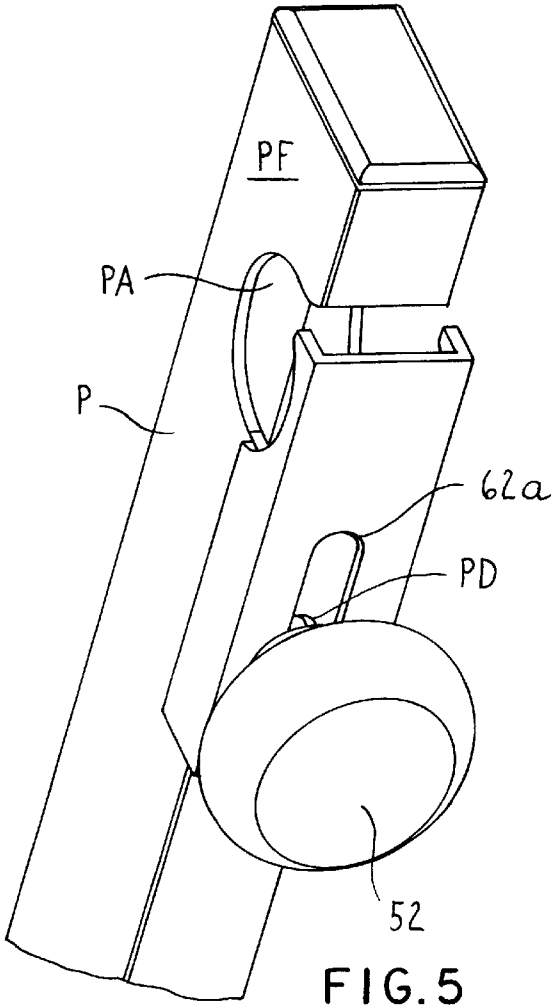

The clamp 6 is designed with a U-shape, the belts 61 of which rest on the sidewalls PS of the associated shaped-section bar P, surrounding same with little clearance, whereas the connecting bar 62 contacts the spacer PD. A slotted hole 62*a* is cut into the bar 62 along the direction of the longitudinal axis 64 of the clamp 6 (FIG. 5). The bolt 51 extends through the slotted hole. The slotted hole allows limited longitudinal movement of the clamp 6. The arrangement is such that (in FIG. 8) the clamp 6 can be moved so far to the right that the slot PA2 is no longer covered thereby. The position of the clamp 6 illustrated in FIG. 8 corresponds with the final position in the assembled state of FIG. 4.

The clamp 6 then clamps the crossbar 12 with a pressure surface 63 arranged in the two belts 61, the shape of which is adapted to the cross sectional shape of the crossbar 12 such that a flat contact is guaranteed and the surface pressure is bearable throughout the contact area.

Listing Of Drawing Reference Numbers And Parts

1 Frame Elements
11 Posts
12 Crossbar
121 Longitudinal Axis
2 Platform
2*a* Upper Platform
2*b* Lower Platform
21 Opening
22 Flap
23 Transverse Edge
24 Longitudinal Edge
'Railing
31 Railing Spars
32 Intermediate Spars
33 Connecting Pieces
4 Reinforcements
41 Longitudinal Reinforcements
5 Locking Device
51 Bolt
51*a* Thread
52 Handle
6 Clamp
61 Belt
62 Bar
62*a* Slotted Hole
63 Pressure Surface
64 Longitudinal Axis
P Shaped-section Bars
PA Aperture
PA1 Upper Area
PA2 Slot
PD Spacer
PE Feed Slopes
PF End Area PL Longitudinal Axis
PQ Axis of Symmetry
PS Sidewall
PU Underside
S Plug

I claim:

1. A clamp connector with structural elements for the assembly of a scaffolding, the structural elements including elongate shaped-section bars and crossbars, comprising:

one of the shaped-section bars having a rectangular hollow shape partially defined by first and second side walls and an underside wall extending between the first and second side walls, means for defining an aperture being in an end area of the one shaped-section bar for receiving one of the crossbars therein the aperture being symmetrical about an axis of symmetry, the axis of symmetry being transverse with respect to the longitudinal axis of the one shaped-section bar, means defining a slot being in the one shaped-section bar, the slot opening from the aperture through the underside wall of the one shaped-section bar so that the aperture can receive the one crossbar therethrough, the aperture being dimensioned such that the one shaped-section bar rests nonmoveably longitudinally on the one crossbar, and a clamp being provided on the end area of the one shaped-section bar, means for moving the clamp at least partially parallel to the longitudinal axis of the one shaped-section bar joining the clamp and the one shaped-section bar, means for locking the clamp in position being provided on the one shaped-section bar, the clamp being moveable between open and closed positions, in the closed position the clamp covers the slot opening into the aperture to pressingly clamp the crossbar in the aperture to resist pivotal movement of the crossbar relative to the shaped-section bar, the clamp having a U-shape including first and second legs, the first and second legs respectively extend over the exterior of the first and second side walls.

2. The clamp connector according to claim 1, wherein at least two of the apertures are provided on the one shaped-section bar, each of the apertures being closeable by respective first and second clamps.

3. The clamp connector according to claim 1, wherein an area of the aperture resting on the crossbar is shaped to rest approximately flatly on the crossbar.

4. The clamp connector according claim 1, wherein the means for locking locks the clamp at least in one closing and one opening position which respectively close and open the aperture.

5. The clamp connector according to claim 1, wherein the clamp is a shaped-section piece which is parallel to the one shaped-section bar.

6. The clamp connector according to claim 4, wherein the clamp is elongate, the shaped-section bar has means for defining a threaded hole, a web is mounted between the first and second legs of the clamp, the web extends in the longitudinal direction of the clamp and has means for defining a slotted hole, and the means for locking has a bolt extending through the slotted hole, the bolt being screwed into the threaded hole of the shaped-section bar.

7. The clamp connector according to claim 6, wherein the bolt is threaded and the means for locking includes a handle provided on the bolt for clamping the clamp in one of the closed and open positions.

8. The clamp connector according to claim 6, wherein a spacer is provided between the web and the shaped-section bar such that the clamp rests on the spacer and is locked by the means for locking approximately parallel to the shaped-section bar.

9. The clamp connector according to claim 1, wherein a pressure surface of the clamp follows the shape of the crossbar, the pressure surface being clamped against the crossbar to pressingly clamp the crossbar to the aperture.

10. The clamp connector according to claim 1, wherein the one shaped-section bar is connected to one of a platform, a diagonal reinforcement railing, a longitudinal reinforcement railing, a transverse reinforcement railing, and an intermediate spar.

11. A connector with first and second elongate structural elements for the assembly of a scaffolding, the first element having four walls to define a generally rectangular profile surrounding a hollow interior and to define an exterior, the first and second walls extending generally parallel to each other, the third wall extending between the first and second walls, comprising:

means for defining an aperture through the first and second walls of the first element, the aperture extending generally transverse the longitudinal direction of the first element;

slot means for receiving the second element into the aperture through the third wall of the first element;

a U-shaped clamp having first and second legs joined by a web, the first and second legs respectively extend over the exterior of the first and second walls of the first element;

means for moving the clamp between a closed position and an open position in a direction parallel to the longitudinal axis of the first element, the closed position closing the slot means to clamp the second element in the aperture of the first element thereby joining the first and second elements together, the open position removing the clamp from the slot to allow the insertion of the second element into the aperture or removal of the second element from the aperture of the first element; and means for locking the clamp in one of the open and closed positions.

12. The connector according to claim 11, wherein the clamp is elongate and has means for defining an elongate hole in the web, and the means for locking includes a bolt extending through the elongate hole and a means for receiving the bolt in the third wall, the bolt fixing the clamp relative to the first element in one of the open and closed positions.

13. The connector according to claim 12, wherein a spacer is positioned between the third wall and the web such that the third wall and the web remain parallel to each other.

14. The connector according to claim 12, wherein the third wall is connected to lower ends of the first and second walls, the lower ends being adjacent the clamp.

15. The connector according to claim 11, wherein the clamp has means for applying pressure on the second element when the second element is received in the aperture and the clamp is in the closed position.

16. The connector according to claim 11, wherein the clamp is elongate and longitudinally extends generally parallel to the first element, the first leg extends longitudinally over the exterior of the first wall, and the second leg extends longitudinally over the exterior of the second wall.

* * * * *